US006954145B2

(12) United States Patent
Nakamura et al.

(10) Patent No.: US 6,954,145 B2
(45) Date of Patent: Oct. 11, 2005

(54) PROXIMATE SENSOR USING MICRO IMPULSE WAVES FOR MONITORING THE STATUS OF AN OBJECT, AND MONITORING SYSTEM EMPLOYING THE SAME

(75) Inventors: Akihiko Nakamura, Kyoto (JP); Atsushi Hisano, San Jose, CA (US)

(73) Assignee: Omron Corporation, Kyoto (JP)

( * ) Notice: Subject to any disclaimer, the term of this patent is extended or adjusted under 35 U.S.C. 154(b) by 238 days.

(21) Appl. No.: 10/228,279

(22) Filed: Aug. 27, 2002

(65) Prior Publication Data

US 2003/0160701 A1 Aug. 28, 2003

Related U.S. Application Data

(63) Continuation-in-part of application No. 10/200,552, filed on Jul. 23, 2002, now Pat. No. 6,879,257, which is a continuation-in-part of application No. 10/119,310, filed on Apr. 10, 2002, now abandoned, which is a continuation-in-part of application No. 10/080,927, filed on Feb. 25, 2002, now abandoned.

(51) Int. Cl.[7] ..... G08B 13/18

(52) U.S. Cl. ..... 340/553; 340/539.23; 340/522; 340/568.1; 340/686.1; 382/154

(58) Field of Search ..... 340/552, 553, 340/539.1, 556, 522, 568.1, 686.1, 539.23; 382/154

(56) References Cited

U.S. PATENT DOCUMENTS 3,898,639 A * 8/1975 Muncheryan ..... 340/529
4,295,131 A * 10/1981 Bonori et al. ..... 342/28
4,319,332 A * 3/1982 Mehnert ..... 342/27
4,652,864 A * 3/1987 Calvin ..... 340/553
4,719,363 A * 1/1988 Gallacher ..... 307/117
4,760,381 A * 7/1988 Haag ..... 340/556
5,138,638 A * 8/1992 Frey ..... 377/6
5,475,367 A * 12/1995 Prevost ..... 340/568.8
5,519,784 A * 5/1996 Vermeulen et al. ..... 382/100
5,682,142 A * 10/1997 Loosmore et al. ..... 340/572.1
5,790,025 A * 8/1998 Amer et al. ..... 340/571
5,828,626 A * 10/1998 Castile et al. ..... 367/93
5,852,672 A * 12/1998 Lu ..... 382/154
5,959,534 A * 9/1999 Campbell et al. ..... 340/573.6
6,208,247 B1 * 3/2001 Agre et al. ..... 340/539.19
6,255,946 B1 * 7/2001 Kim ..... 340/556
6,333,691 B1 * 12/2001 Janus ..... 340/552

FOREIGN PATENT DOCUMENTS

JP 9-274077 A 10/1997

* cited by examiner

*Primary Examiner*—Benjamin C. Lee
(74) *Attorney, Agent, or Firm*—Foley & Lardner LLP

(57) ABSTRACT

The objective of the present invention is to provide proximity sensors employing impulse waves to detect the characteristics of objects lying inside the object of surveillance, such as a container, including their distance, the reflection strength from an object, the speed an object is moving, etc., as well as to provide a status surveillance system which detects, from the data from the proximity sensors, that the inside of the container remains unchanged. To achieve the foregoing objectives, the present invention adds proximity sensor functions to wireless communication nodes inside of the object of surveillance, such as inside of a container. Said proximity sensors output microimpulse waves from the wireless communication nodes, and said communication nodes receive the reflections of those waves from nearby objects. The wave reception sampling is performed based upon the bit signals of the clock for the microimpulse transmissions and the local clock, and the analysis of the received signals enables the highly precise measurement of the distance to an object using simple circuitry. It is then possible to detect an abnormal occurrence inside the object of surveillance by comparing the characteristic data obtained from the initial environment with that data obtained during the period of surveillance. Further, the proximity sensing function is able to detect the direction of any penetration.

13 Claims, 11 Drawing Sheets

Configuration of communication node

Figure 3. Detailed component diagram of the proximity sensor

Figure 4. Impulse waveform (left) and its frequency distribution(right)

Figure 5. Principle of waveform extraction processing

Figure 6

| | Proximity data (sensor data) for the proximity of the various nodes | | | |
|---|---|---|---|---|
| | First reflected wave | Second reflected wave | Third reflected wave | Fourth reflected wave |
| | Distance, Strength,Speed | Distance, Strength,Speed | Distance, Strength,Speed | Distance, Strength,Speed |
| N1 | (12、5、2) | | | |
| N2 | | | | |
| N3 | (10、7、0) | | | |
| N4 | (14、4、0) | (18、2、3) | | |
| N5 | | | | |
| N6 | (8、4、0) | | | |

| | N1 | N2 | N3 | N4 | N5 | N6 |
|---|---|---|---|---|---|---|
| N1 | 0 | 30 | 40 | 25 | 50 | 80 |
| N2 | 30 | 0 | 24 | 67 | 43 | 75 |
| N3 | 40 | 24 | 0 | 36 | 41 | 55 |
| N4 | 25 | 67 | 36 | 0 | 74 | 58 |
| N5 | 50 | 43 | 41 | 74 | 0 | 24 |
| N6 | 80 | 75 | 55 | 58 | 24 | 0 |

Figure 10

PROXIMATE SENSOR USING MICRO IMPULSE WAVES FOR MONITORING THE STATUS OF AN OBJECT, AND MONITORING SYSTEM EMPLOYING THE SAME

These are now pending as patent applications: U.S. patent application filed Feb. 25, 2002 (application Ser. No.: 10/080,927), U.S. patent application filed Apr. 10, 2002 (application Ser. No.: 10/119,310), and U.S. patent application filed Jul.23, 2002 (application Ser. No.: 10/200,552).

FIELD OF TECHNOLOGY OF THE INVENTION

The present invention relates to a status surveillance system and to the proximity sensors it employs, which either monitor the space proximate to the object of surveillance (e.g. inside of warehouse, containers, vehicles, office or dwelling rooms, our the area outside of a garage) by using microimpulse waves transmitted by a plurality of communication nodes positioned on inside walls, and the detection of those reflections off the objects stored inside the space, or by using proximity sensors to monitor an object of surveillance to detect the presence or absence of an unauthorized penetration by a dangerous article through its walls. The invention further relates to a status surveillance system for the object of surveillance, such as a container, determines the distance between the communication nodes at designated time intervals during its transport, and notes any differences in those distances as the detection of unauthorized access from the outside.

BACKGROUND OF THE INVENTION

As exemplified by the terrorists attacks in the United States on Sep. 11, 2001, the increasingly frequent acts of terror internationally dictate the importance of risk management for freight containers that are transported by aircraft, ships, freight trains and trucks. The possibility exists that a terrorist could secrete a nuclear weapon, explosives, poison gas, a biological weapon, or radioactive substance into a freight container and send it anywhere. Freight containers are used to ship wide variety of products and raw materials. It has been estimated that 18 million containers arrive in the United States annually. Currently, only about 2% of those are inspected. There are cases in which X-rays can be used from the outside of the container and the resulting image be analyzed to identify dangerous items that have been secreted therein. In addition, radiation detectors and odor sensors can also be used to identify some dangerous articles. However, considering the diversity of possible threats and the number of ways that dangerous articles can be packaged to appear innocuous, it must be concluded that detection of dangerous articles is not possible in most cases. It must further be considered that dangerous articles are not always secreted into containers after they are closed, these articles could be placed into the container in the first place, or containers can be swapped out for others. Theft of cargo from containers has long been a problem, but there exists a clear risk that such theft rings can work in league with terrorists to secrete dangerous articles into the containers even as they steal cargo from them. Since it is not easy to use sensors to check cargo for danger, there are movements afoot to check the reliability of the shippers to evaluate the risk of the cargo they load. However, an empty container, which has no shipper, cannot be evaluated based on the reliability of a shipper. Since the demand for container transportation of cargo is not stable, varying by geographical area and the season of the year, there are many cases when empty containers must be transported among many countries by air, ship, rail and truck. This transportation of empty containers brings no profit to freight shippers, and accordingly, there is a strong tendency to avoid the cost of security measures when shipping empty containers. Thus, there is a high possibility that an empty container could be used as a terrorist tool. It follows that the surveillance and reporting of any unauthorized opening of an empty container's doors or walls is a very important anti-terrorism measure. To wit, as anti-terrorism measures, it is necessary to (1) monitor and report any unauthorized access to the inside of a container be it loaded with cargo or empty, and (2) to detect and report any switching of containers. In particular, since a terrorist, etc, might unlawfully secrete individual dangerous articles, no matter what their type or origin, into containers, it is vital to perform surveillance and report any unauthorized access to detect such actions. Further, the detection of any breach of the walls of a container, etc. by a suspicious article cannot be limited to a localized penetration detection system, the entirety of the wall surfaces must be subject to surveillance.

PRIOR ART

In general, the detection of the penetration of a wall surface from the outside has been performed by placing motion sensors or heat sensors upon the wall surface, which enables the detection of the suspicious activity involved in causing a suspicious article to penetrate that wall. In the case of a home, the required number of motion sensors have been placed on the inside or outside of the wall surfaces, with any detection signal being monitored either locally or centrally. The installation conditions for such conventional types of wall sensors was fixed, and accordingly they were unable to provide high levels of security against terrorists or the like. In particular, the signal from such fixed wall mounted sensors could be reproduced by a terrorist, etc., and be easily manipulated in such a way as to signal no suspicious penetration. Further, when such sensors were not used in a stationary place such as a room, but rather inside a container or other such mobile object, at a place far removed from the security administrator, they were even more prone to unlawful manipulation.

FIG. 11 shows the object motion detection apparatus disclosed in Japanese Patent Publication (Kokai) Hei 09-274077. Not only could it detect the movement of an object that does not emit heat, but using only a small number of devices, it could detect any motion and not falsely operate due to light or heat. The object motion detection apparatus employed a transmitter means 1, which transmitted a diffusion modulated spectral diffusion wave with a prescribed diffusion code that could be reflected inside the detection space 2. A receiver means 3, would output a relative peak signal that corresponded to the reception signal strength each time it received a spectral diffusion wave that matched the diffusion code being used by transmitter means 1. An object, such as a human 4 moving inside the detection space 2 would cause a change in the propagation signal path taken by the spectral diffusion waves being propagated inside the detection space, then the output from the receiver means would show a change in the relative peak signal that corresponded with the aforementioned change. Detecting the change in the output from the relative peak signal thereby enabled the detection of movement by an object, such as human 4, inside detection space 2.

However, with this sort of object motion detection apparatus, it would not always be possible to detect the penetration of a wall of a container, for example, that held both the transmitter means 1 and receiver means 3. Such a system would also be easily affected by the cargo inside the container. Further, reflection of the electronic waves by a suspicious article incoming at a dead angle would not allow adequate detection of the suspicious article.

Further, inasmuch as such conventional motion detectors, in their detection of unauthorized penetration, are applied in fixed positions inside the object of surveillance such as a container, their data could be easily but unlawfully manipulated by an inside worker on behalf of a terrorist, etc.

Further still, inasmuch as such conventional motion detectors, in their detection of unauthorized penetration, are unable to discern the position or the direction of the unauthorized penetration, they cannot produce detailed data on the unauthorized penetration such as at what velocity the penetration was made, and accordingly, even if they could detect the fact of an unauthorized penetration, they could not be used as the basis for a response thereafter.

Additionally, in object penetration detection systems of the prior art that employed a plurality of sensors using impulse waves, the output impulse waves from the sensors tended to interfere with each other making them difficult to function as detection systems.

SUMMARY OF THE INVENTION

The first objective of the present invention is to provide proximity sensors employing impulse waves to detect the characteristics of objects lying inside the object of surveillance, such as a container, including their distance, the reflection strength from an object, the speed an object is moving, etc., as well as to provide a status surveillance system which detects, from the data from the proximity sensors, that the inside of the container remains unchanged.

The second objective of the present invention is to provide proximity sensors which can monitor the entire wall surface of the object under surveillance and detect any unauthorized penetration of its walls, and to provide a status surveillance system employing said sensors. Particularly, the present invention enables the detection of movement by objects emitting no heat, the detection of object movement throughout a broad space using but few sensors, and further, the provision of motion detection sensors not subject to false operation due to heat or light.

The third objective of the present invention is to provide proximity sensors which, when a plurality of sensors are installed to detect objects within a broad space, experience no interference among the electronic waves emitted from the plurality of sensors, to thereby provide a smoothly working system by means of shifting the transmission time of the electronic waves from the sensors to assure that the transmissions of one do not affect the others.

A fourth objective of this invention is to provide a status surveillance system that can detect any physical movement inside of the surveillance space by means of installing inside of the space, a plurality of communication nodes having the foregoing proximity sensor function, and using the data obtained from the proximity sensors, to perform the detection based upon distance information among the plurality of communication nodes.

To achieve the foregoing objectives, the present invention adds proximity sensor functions to wireless communication nodes inside of the object of surveillance, such as inside of a container. Said proximity sensors output microimpulse waves from the wireless communication nodes, and said communication nodes receive the reflections of those waves from nearby objects. The wave reception sampling is performed based upon the bit signals of the clock for the microimpulse transmissions and the local clock, and the analysis of the received signals enables the highly precise measurement of the distance to an object using simple circuitry. It is then possible to detect an abnormal occurrence inside the object of surveillance by comparing the characteristic data obtained from the initial environment with that data obtained during the period of surveillance. Further, the proximity sensing function is able to detect the direction of any penetration.

Further, in a network comprised of a plurality of wireless communication nodes having a proximity sensor function, it is possible to measure the distance between the communication nodes and the respective electronic field strength at those distances. Any changes to the object in which the network was installed would change the relative distance and wireless communication link status between the wireless communication nodes. The network in the present invention is configured to also sense any changes in the object under surveillance from any changes in the network structure information.

To wit, the principle of the present invention, as shown in FIG. 1, involves the mounting of a plurality of communication nodes with transmitting antennas on a container's inside walls, and which transmit a microimpulse wave at a specific strength, and that output microimpulse wave reflects off of the penetration object 2, and is received by the receiving antennas 3 to comprise the proximity sensor PS. The change is then detected in reflected wave RW between the waveform from the pre-penetration RW-1 to the post-penetration RW-2. In other words, the frequency component of the reflected wave RW is affected by the velocity of the penetrating object, and further, since the physical properties of the penetrating object affect the amplitude component, the post-analysis of the reflected wave RW makes it possible detect the state of the object under surveillance, for example, the inside of a container.

The present invention further provides for the measurement of the distances between all of the desired number of communication nodes, and those distances are recorded in advance. Then, should a suspicious object penetrate or be taken from the container during its transport, the propagation state of the microimpulse waves inside the container would change, and that change can be detected. The prerecording of the distance between the various communication nodes can be used as a type of fingerprint information, and by detecting any change in that fingerprint thereafter, it is possible to detect whether a suspicious object has been secreted into the container or whether any of the cargo has been taken out.

Further, the present invention can configure the proximity sensors PS with respect to the container walls so that there are outputs of two layers, top and bottom of the microimpulse waves. Accordingly, should a suspicious article be secreted through the wall surface, it is possible to detect which of the two layered detection area detected it first, and whether the penetration was from outside to inside or vice versa, inside to outside.

The proximity sensors PS according to this invention emit impulse waves based upon a standard signal clock, and it is possible to transmit such impulse waves over a broad area. The reflections of the impulse waves are sampled in synch with the FM modulated transmitted waveform to mix with locally oscillated waves, the waveform will show any reflections off of secreted suspicious object(s), through the analysis of the waveform after mixing to detect the secretion of suspicious objects.

BRIEF DESCRIPTION OF THE DRAWINGS

FIG. 6 shows the proximity data for the proximity of the various nodes in the proximity sensor of the first embodiment.

FIG. 10 is a network graph matrix of the results data for the distance between nodes using the invention's distance measuring function.

DETAILED DESCRIPTION OF THE INVENTION

Figure 1:
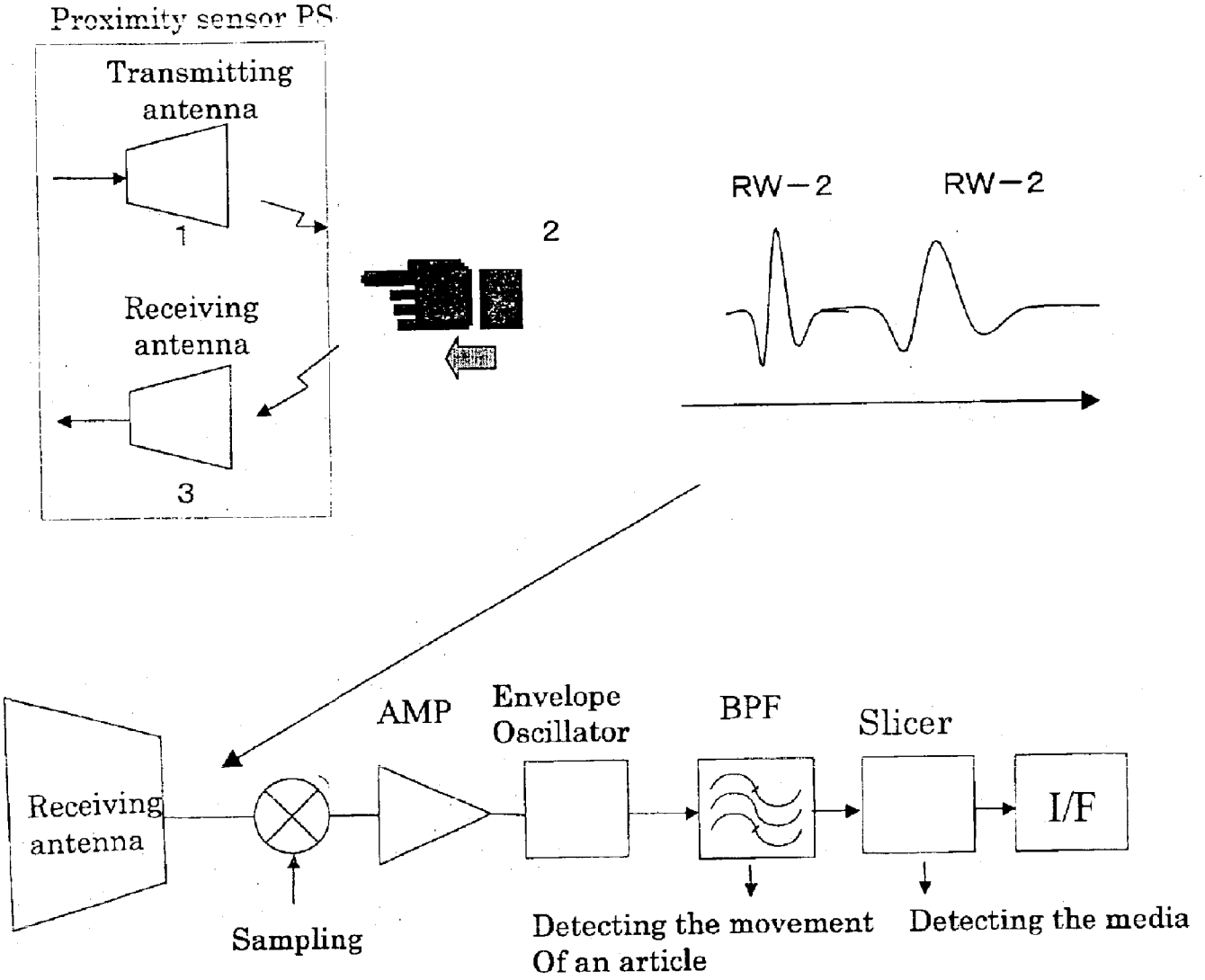
FIG. 1 is an abbreviated concept diagram used to explain the operating principle of the present invention.

In this section we shall explain several preferred embodiments of this invention with reference to the appended drawings. Whenever the size, materials, shapes, relative positions and other aspects of the parts described in the embodiments are not clearly defined, the scope of the invention is not limited only to the parts shown, which are meant merely for the purpose of illustration.

Definitions

Terms used in the specification shall have the below specified definitions.

1) Communication Node

A communication node is a node used to form a communications network. These communication nodes use UWB (ultra wide band) waves in their proximity sensors, and further, they employ data communications and distance measurements to determine their distance from other nodes.

2) Control Device

The communications device may be called a parent node among the various communication nodes in the communications network; it is a special node that incorporates a memory function, and a function to receive data from outside communications facilities.

3) Node Distribution Information

Node distribution information is the information on distribution of other nodes in the space with respect to a certain single node in the network. Said specific node can express the distances to other nodes. This node distribution information, as will be described later, can express all of the distribution relationships between all of the nodes as a network graph matrix using the information on node distribution. In other words, the network graph matrix expresses the distribution in its columns or rows.

4) Status information for the object of surveillance

What is meant by the status information for the object of surveillance is at least one of the following types of information: (1) changes in the object of surveillance, (2) position of the object of surveillance, (3) distribution of the proximity of the objects of surveillance, (4) movements of objects in the vicinity of the object of surveillance.

5) Network Structure Information

This is the information about the entire wireless communication network structure comprised of the plurality of nodes attached to the object of surveillance. This network structure information consists of the synthesized information of the node distribution information, which may also be obtained in the form of the network graph matrix.

6) Network Graph Matrix

The entire structure of the wireless communication network comprised of a plurality of nodes attached to the object of surveillance can be expressed as a matrix using the link status between any two nodes as elements. Here, the link status between nodes means the inter-nodal communication status including the distance between the nodes, a flag dictating whether or not a message can be transferred directly between nodes, the communications speed between nodes, the electrical field strength at the transmitting and receiving nodes of the transmitted and received electrical waves, etc.

In the network graph matrix, the (s, p) element, is the value of the distance between s, p between any two nodes, and is expressed as the (s, p) element in the network graph matrix. In the status surveillance system of the present invention, the standard network graph matrix is compared at appropriate intervals with the network graph matrix obtained during surveillance to check for any change in the object of surveillance. In other words, the standard network graph matrix may be detected at the time of shipment, and then after that, the network graph matrix will reveal that the contents of the container are either unchanged or abnormal. Any change at all in the container causes the network graph matrix to change.

7) Fingerprint

Since the network configuration of node distribution, as expressed by the network graph matrix, differs for each network, the matrix showing the network structure can be used as a specific fingerprint for each network. Accordingly, in some instances, the network graph matrix will be referred to as the fingerprint. The number for each node in the configuration of the network graph matrix can be randomly generated, and if data for the corresponding node number is included for each row and column of network graph matrix, even if another network were to duplicate the exact placement of the nodes, the network graph matrix would be completely different and unique for each network to thereby serve as a true fingerprint.

System Configuration

Figure 2:
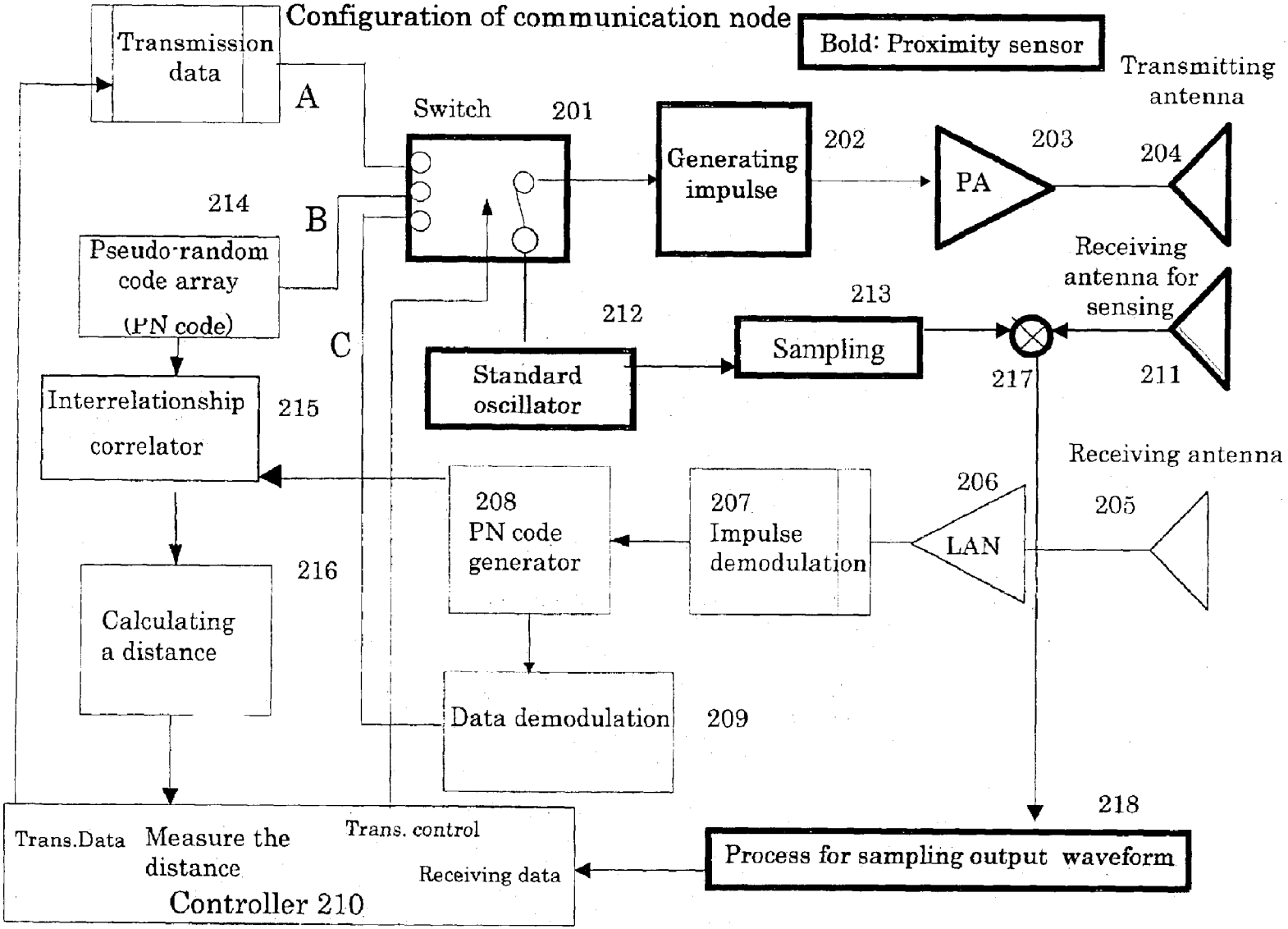
FIG. 2 is a hardware component diagram of a proximity sensors in the communication nodes and the distance measuring capabilities between nodes of a first embodiment of this invention.

FIG. 2 is a block diagram of wireless communication node 2 which includes a data communication function, proximity sensing function, and the capability to measure the distance between it and other wireless communication nodes. A plurality of said communication nodes are installed inside the object of surveillance, a container for example, in either a random or regular manner upon the inside wall surfaces. In order that the nodes do not come into direct contact with the cargo inside the container, they are installed using an adhesive, etc. in the concave areas that wind back and forth along the wall surface. Using batteries (not shown) as a power source, the nodes are capable of communicating with each other. There are no particular restrictions upon the distance between the nodes, so long as they are capable of intercommunication.

Data Communication Mode

During their initialization after being powered ON, each wireless communication node waits in a mode where it functions to communicate data (the data communication mode). To wit, the switch 201 is in the A position. In 202, the transmission data is transmitted as a microimpulse wave via PA203 through transmission antenna 204 to another communication node 2. The microimpulse signal output from the other communication node 2 is received by the receiving antenna 205, amplified at LNA206 and then impulse demodulated at 207. Following regeneration at PN code generator 208, data demodulation takes place at 209, and then the received data is input into controller 210. The commands and data contained in the received data are reviewed in this controller 210, and if that information is such to be processed at its own node, it is processed. Communication by each of the wireless communication nodes 2 with the foregoing data communication node enables the transmittal of its own node number to the other wireless communication nodes. This can be realized using protocols known to the art. Thus, in this data communication mode, each of the wireless communication nodes on the network shares the node number information and information on the structure of the network.

Proximity Sensing (First Embodiment)

Thus, in the data communications mode, the communication nodes 2 inside the object of surveillance, the container, share a variety of basic data relating to the data communication nodes, and then, the proximity sensing according to the present invention is implemented in the numerical order of the wireless communication nodes, or in some other specific order. What is meant by proximity sensing is that each of the communication nodes output a microimpulse wave, which when reflected off the objects situated inside the container (the transport cargo), allows data regarding the distance between the objects and the proximity sensors, the strength of the reflections, and in the case of movement, the speed of that movement to be detected. More specifically, the object of surveillance, the inside of the container, is thereby guaranteed to be in a safe state. For example, if a regular shipping worker loads the container and then, prior to its being shipped, obtains the various types of standard data values and guarantees those contents to be safe at shipment, the proximity sensors can then compare the data for each of the timed impulses with the data that was obtained when the contents were guaranteed to be safe, and detect any changes in the status of the container interior.

Figure 3:
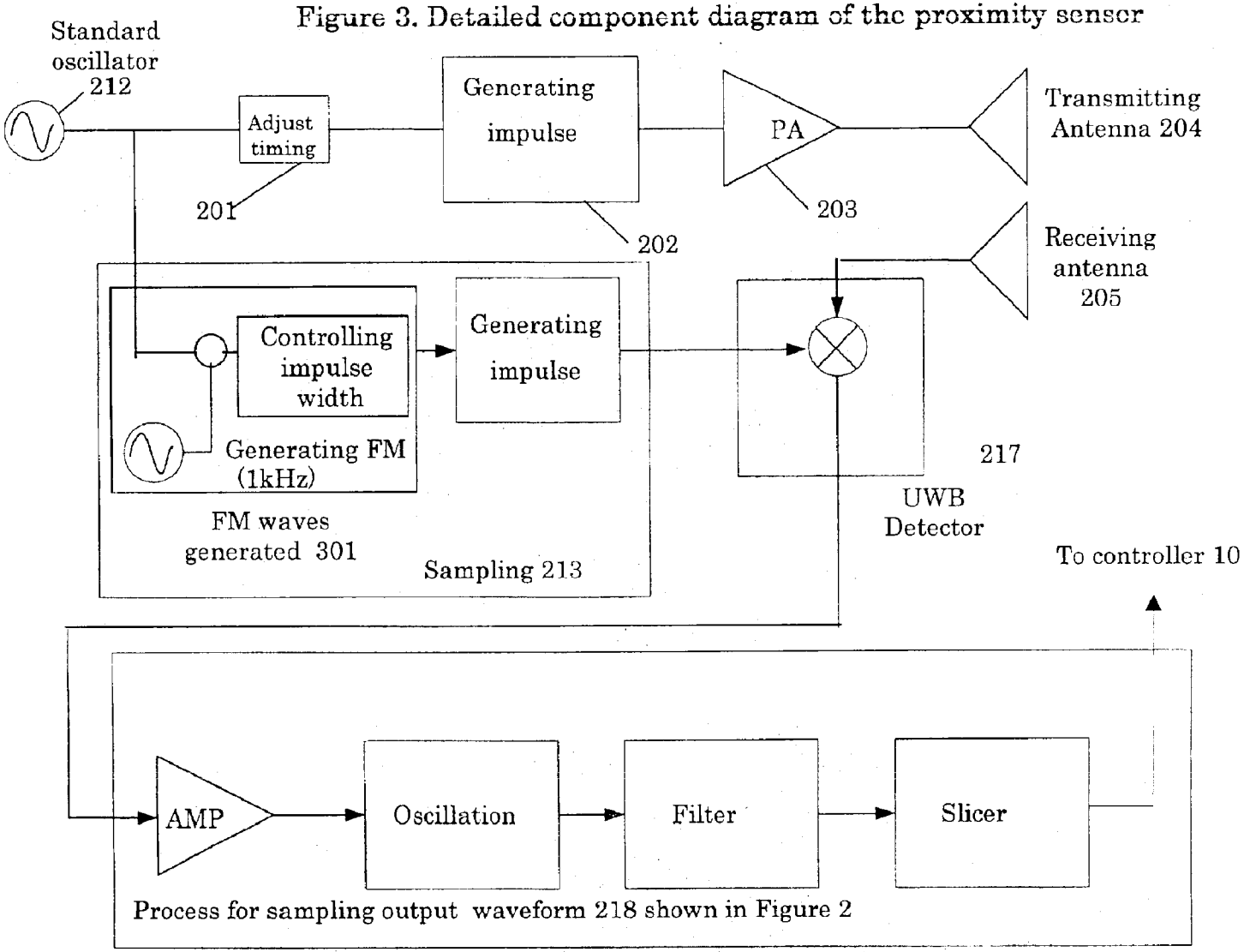
FIG. 3 is a detailed component diagram of the proximity sensors of the first embodiment of the invention.
Figure 4:
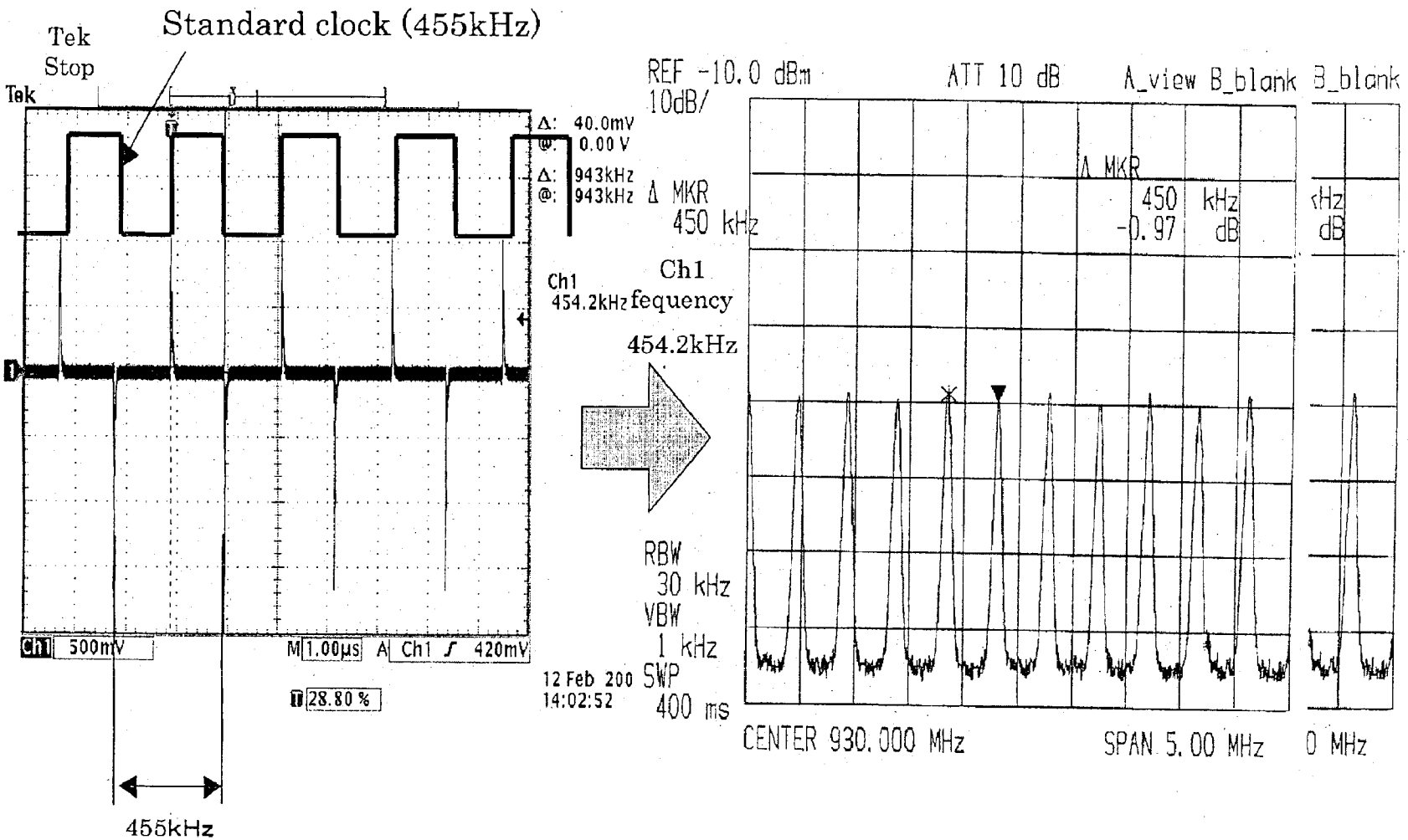
FIG. 4 shows the impulse waveform and its frequency distribution.
Figure 5:
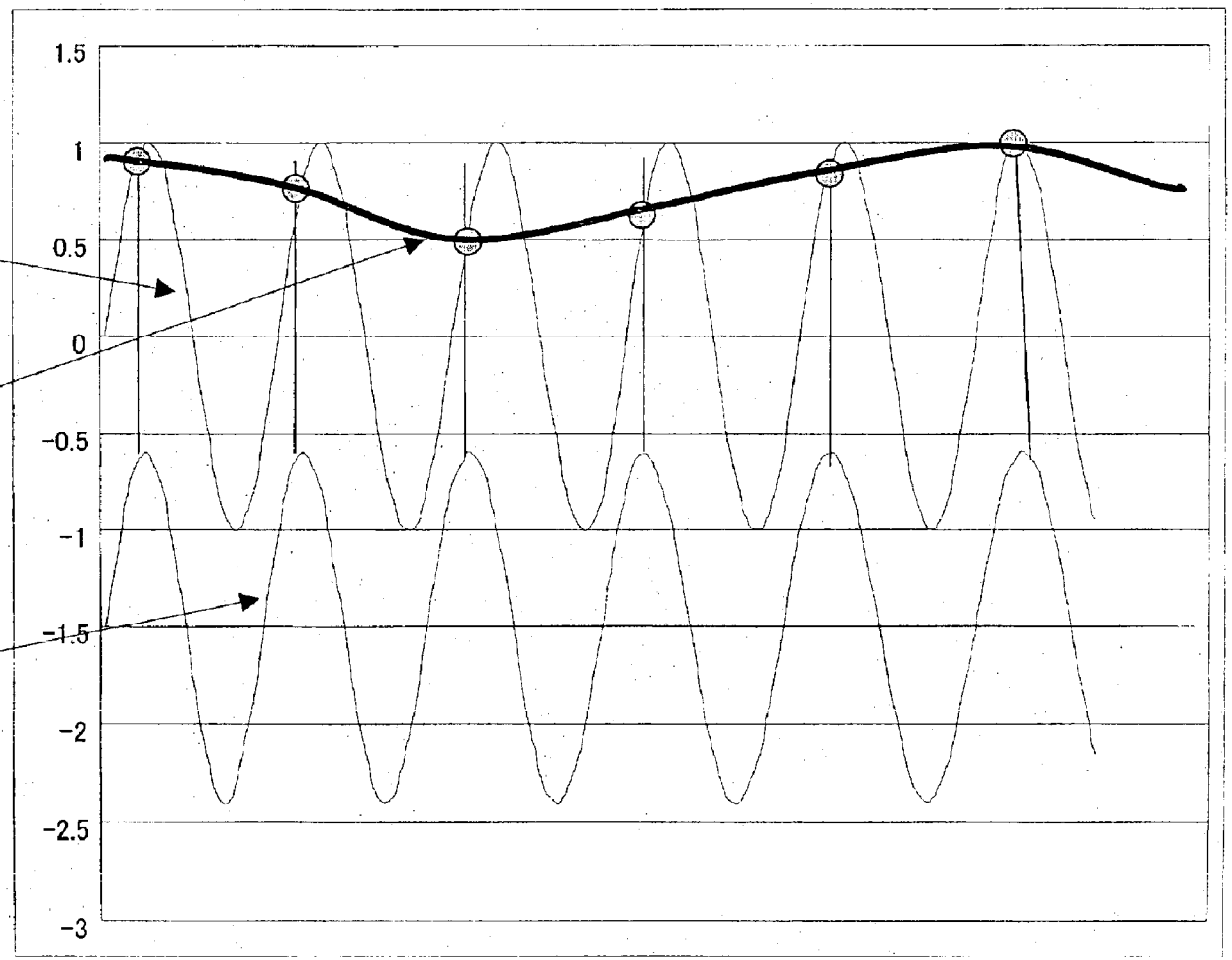
FIG. 5 shows the principle of waveform extraction processing of one of the impulse frequency components from the received waveform.

Specifically, this proximity sensing which detects objects lying inside the container, performs the proximity sensing shown in each block surrounded by the thick lines in FIG. 2. An even more detailed block diagram is shown in FIG. 3. First, the switch 201 for the communication node 2 is connected with the sensor's standard oscillator 212. At the sensor's standard oscillator 212, the standard clock (for example, the 455 KHz clock shown in FIG. 4) causes the FM oscillator 301 shown in FIG. 3 to oscillate for at least the time required for a full wave cycle. The standard clock converts the impulse wave generated by impulse generator 202, and at PA203 it is amplified before being transmitted from transmission antenna 204. The impulse wave transmitted from transmission antenna 204 is reflected off of objects lying inside the container, and the reflected wave is then received by sensing reception antenna 211. After amplification, this reflected wave received by the sensing reception antenna is subjected to sampling at 213, and the sampling output waveform is processed at 217. FIG. 5 shows the principle behind the waveform processing 217. To wit, the transmitted impulse wave is received as a reflection wave 501, which is FM modulated in synch with the transmission waveform to obtain localized oscillation 502 (the impulse component is FM modulated at a 1 kHz bandwidth) which is then mixed to obtain a synthesized waveform 503 from the reflected waveform and the FM modulated wave component. Any changes in the reflections off of the objects appear in the post-mixing waveform 505. Accordingly, if the structure is such that these post-mixing waveforms 505 are detected at specific time intervals, it is possible by means of the proximity sensors in the foregoing communication nodes to accurately portray the positional relationships inside of the container.

Thus, this structure makes it possible, using a low speed circuit, to detect the impulse waveform received by the sensing receiver antenna. In this case, the time interval between the transmitted impulses is set to be adequately longer than the time required for the impulse to be reflected and return. This prevents any overlap between the last part of the reflection of the previous impulse with the first part of the reflection of the following impulse. It is also possible with impulse response waveform processing to record, based upon the time the impulse was transmitted, the reception time for the peak position of the impulse response wave, its amplitude, and the frequency of the impulse. There are cases where there are multiple impulse response waves to a single transmitted impulse. In this case, the recorded peak positions, amplitude and frequency of the impulse response wave can be used to indicate the distance between an object proximate to the wireless communication node, the reflection characteristics of the object and the speed at which it may be moving.

This type of processing is implemented by each of the wireless communication nodes in order, and the resulting proximity data from the computations by each of the wireless communication nodes can be recorded. As a result, the proximity data from each of the wireless communication nodes can be used as status information on the object of surveillance. FIG. 6 shows an example of proximity data obtained by the proximity sensors installed in each communication node, which from the reflections off of the objects in the container, reveals the status of those objects. More precisely, FIG. 6 shows the status information on objects for communication nodes N1 through N6, where their proximity sensors, such as in node N1 measure distance, reflection strength and speed (12, 5, 2). Although it would differ according to the container's size and the strength of the output from the proximity sensors, at N1, data was obtained only for the first reflected wave, no second, third or fourth reflected waves were detected. For node N2, there were no proximate objects from which reflections could be detected, and accordingly, no detection data is present. Node N2 similarly detected only a first reflected wave and the resulting distance, reflection strength and speed were measured at (10, 7, 0), respectively. The proximity sensor at communication node N4 detected a first and second reflection, and the respective distances, reflection strength, and speed were measured as (14, 4, 0) and (18, 2, 3). No reflected waves were detected by N5, and N6 brought in measurement values of (8, 4, 0).

These distance and reflection strength values should not change if there is no unauthorized access to the object of surveillance, which is the cargo inside of the container. Accordingly, prior to the shipment of the container, the proximity data from each wireless communication node is transmitted to a distant control apparatus (not shown) in an operations center where it is recorded. To maintain the security of this information, the status information may be encoded prior to its transmission to the center and it also may be shared by each node on the wireless communication network. After the container is shipped, surveillance monitoring begins and the proximity sensors in each of the wireless communication nodes make a periodic detection of the proximity data to determine the status of the objects and if any change has taken place. An object under surveillance having a speed recorded in the proximity data indicates the detection of a penetration. The point of penetration is taken to be the area around the wireless communication node that detected the object having a speed component. Should the wireless communication node that detected the movement become inoperative directly after the detection, that would be deemed as an attack upon that wireless communication node and would be reported to the center, and the network graph matrix, etc. that was memorized by the wireless communication network could then be erased.

Proximity Sensing (Second Embodiment)

Figure 7:
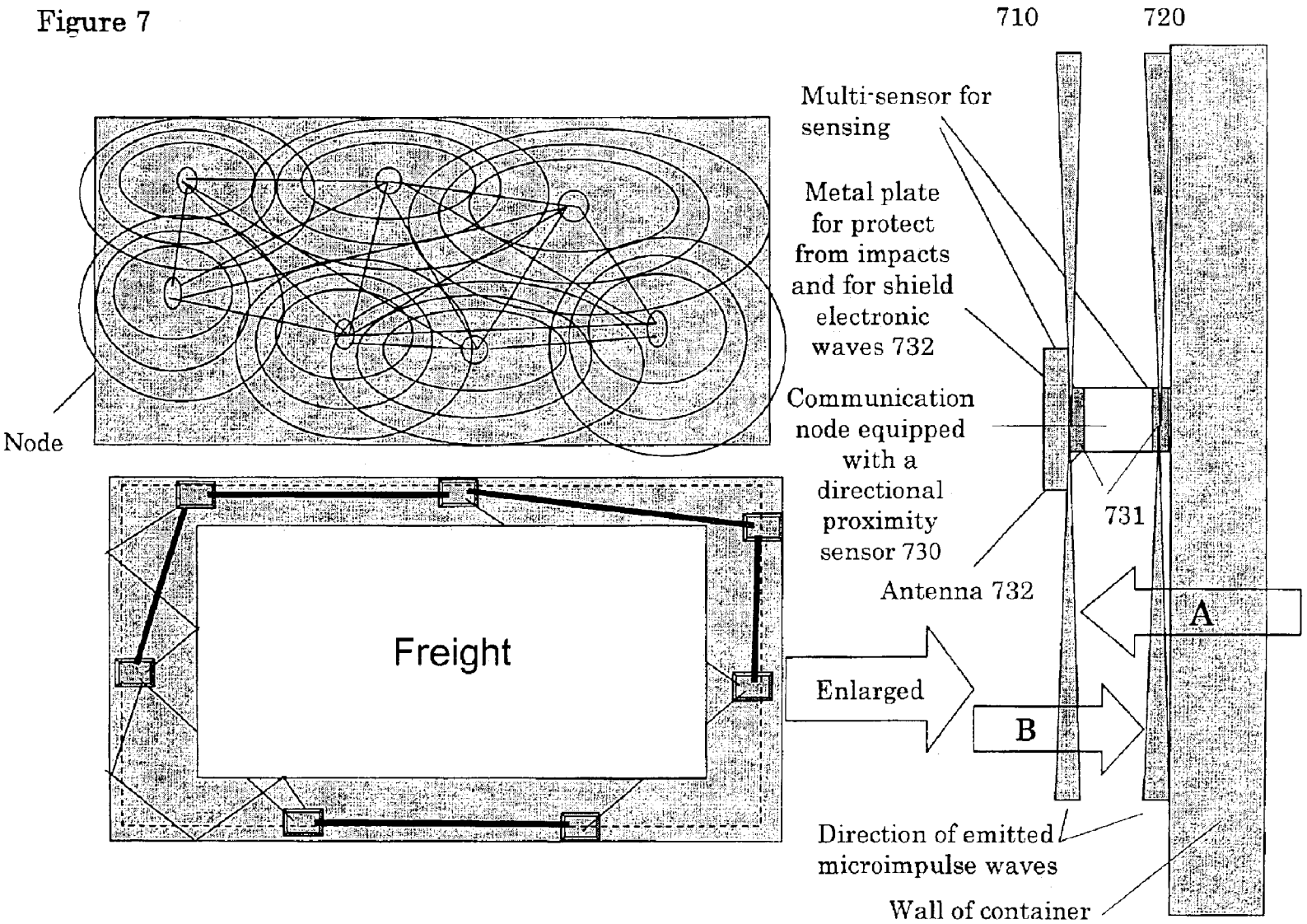
FIG. 7 shows the principle of operation of a second embodiment of this invention in which the proximity sensors can detect the direction of a penetrating object.

The second embodiment of proximity sensing according to this invention differs from the first embodiment's proximity sensor, which output three dimensional microimpulse waves from a transmitting antenna. As shown in FIG. 7, the proximity sensors output a plurality of film like layers that run approximately parallel to the inner walls of the container. More precisely, each communication node 730 is equipped with a directional proximity sensor having a plurality of slots 731 (in this example, two slots) of a specific width. The structure is such that microimpulse waves 710 and 720 emitted through these two slots 731 are output in a direction that is parallel to the side wall of the container. A metal plate 732 having the required properties is installed on the side facing the inside of the container over each of the directional proximity sensor-equipped communication nodes 730 in order to protect them from impacts and to shield their electronic waves. As will be described below, metal plate 732 also functions as a transmitting antenna used for measuring the distances between nodes. This type millimeter wave band slotted array antenna is described in detail in *Millimeter-Wave Slotted Waveguide Array Antenna for Automotive Radar-System* in (R&D Review of Toyota CRDL Vol. 36 (2001.9)).

Figure 8A:
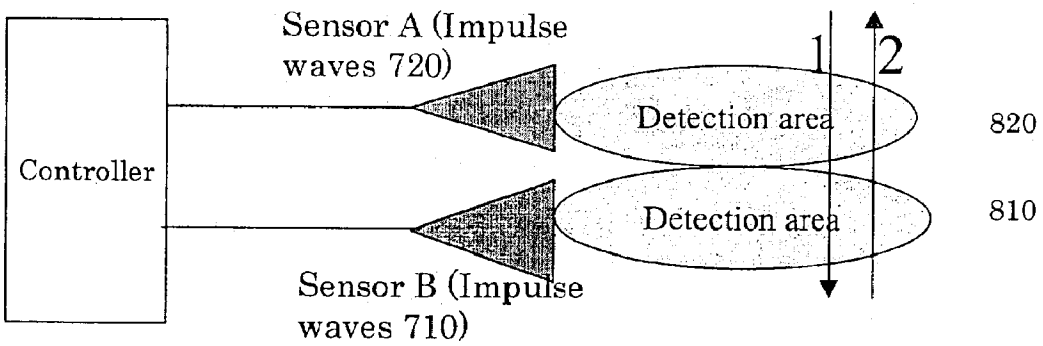
FIG. 8*a* shows the output waveform for the detection by the proximity sensors of the second embodiment of an object passing in the (1) direction.
Figure 8B:
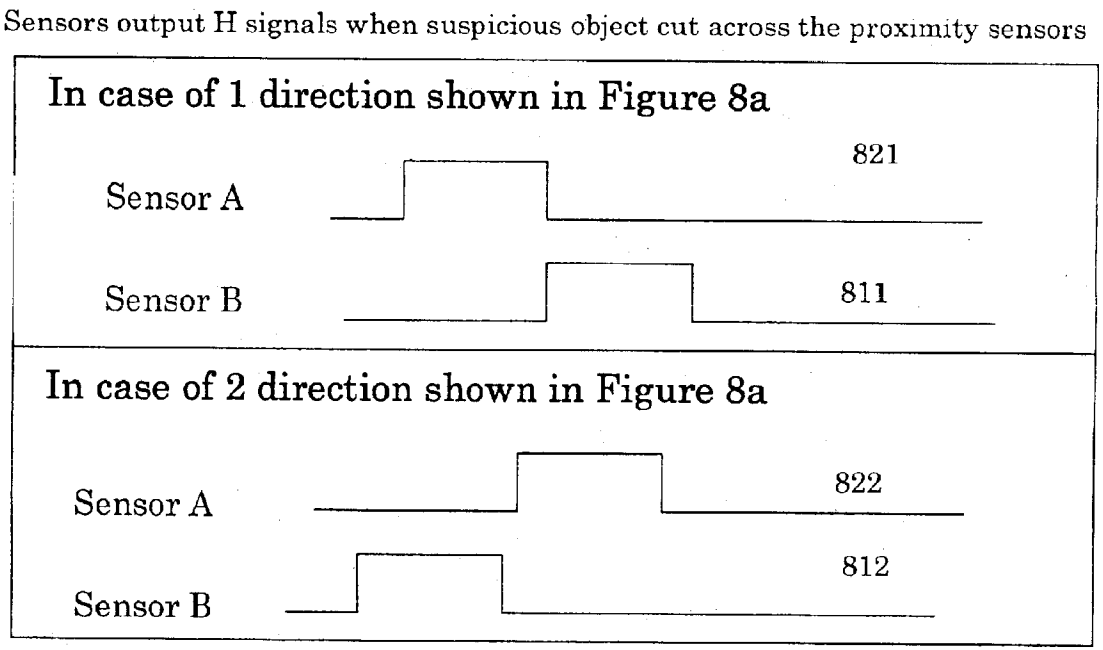
FIG. 8*b* shows the output waveform for the detection by the proximity sensors of the second embodiment of an object passing in the (2) direction.

As shown in FIG. 8*a*, the proximity sensors according to the second embodiment are structured to have two-layered detection areas 810 and 820 to handle the two layered microimpulse waves 710 and 720. Accordingly, should a suspicious object penetrate from the outer wall side of the container toward the inside (to wit, in the direction of arrow A in FIG. 7), the suspicious object, as shown in FIG. 8*a*, would be detected in area 820 by proximity sensor A on the inside wall surface of the container, and then be detected in area 810 by sensor B on the toward the inside of the container (in the direction of arrow (1)). In this case, FIG. 8*b* shows the suspicious object cutting across the proximity sensors in the (1) direction, at which time sensor A reaches the H level followed with a slight delay by sensor B reaching H. Conversely, should the suspicious object then pass through the container toward the outside (to wit, in the direction of arrow B in FIG. 7), as shown in FIG. 8*a*, the suspicious object would be detected first in area 810 and then in area 820 (the direction of arrow (2)). In this instance, the suspicious object cut across the proximity sensors in the direction (2) shown in FIG. 8*b*, and sensor B first reaches H followed with a slight delay by sensor A reaching H.

Figure 9:
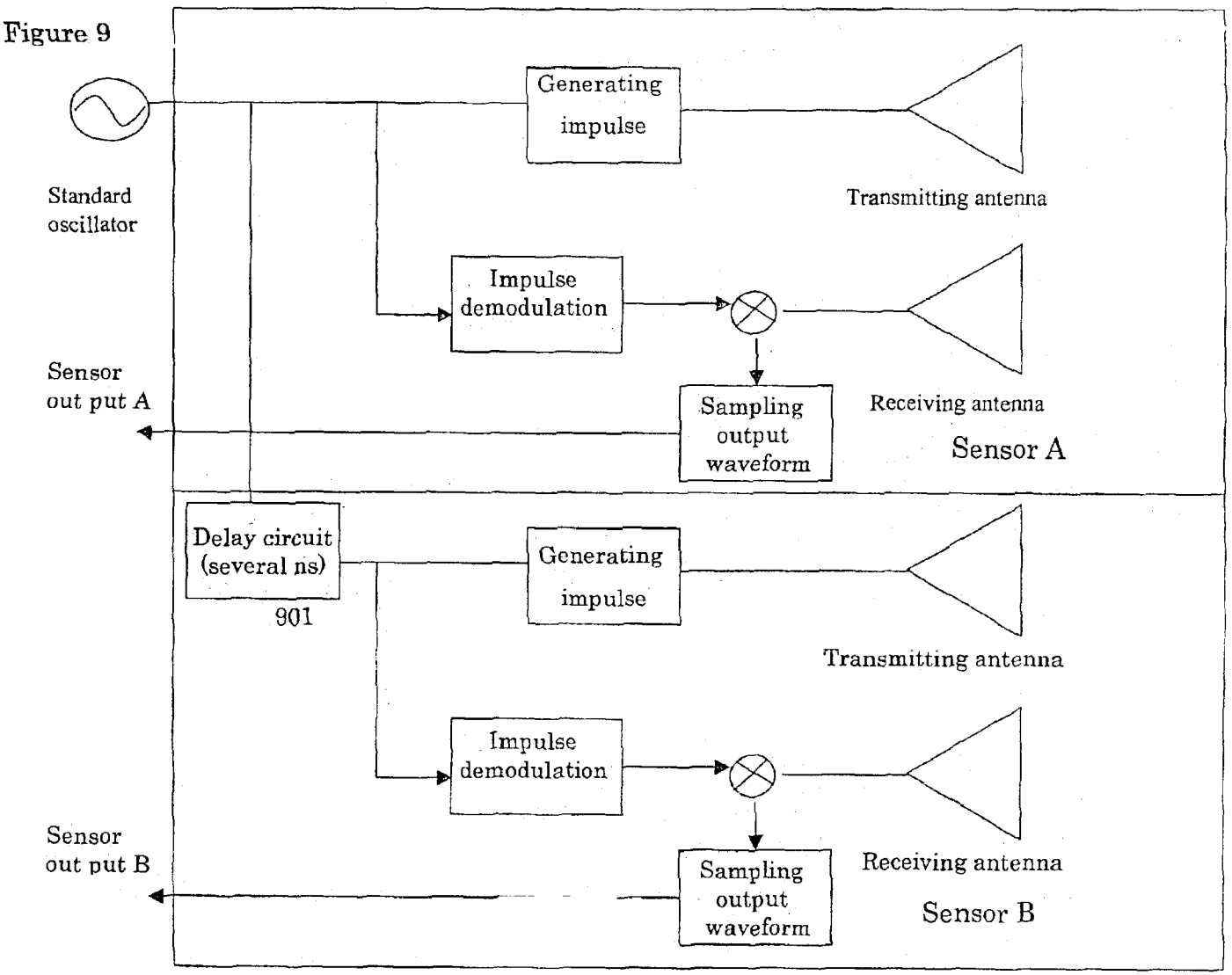
FIG. 9 shows an abbreviated hardware component diagram for the proximity sensors of the second embodiment.
Figure 11:
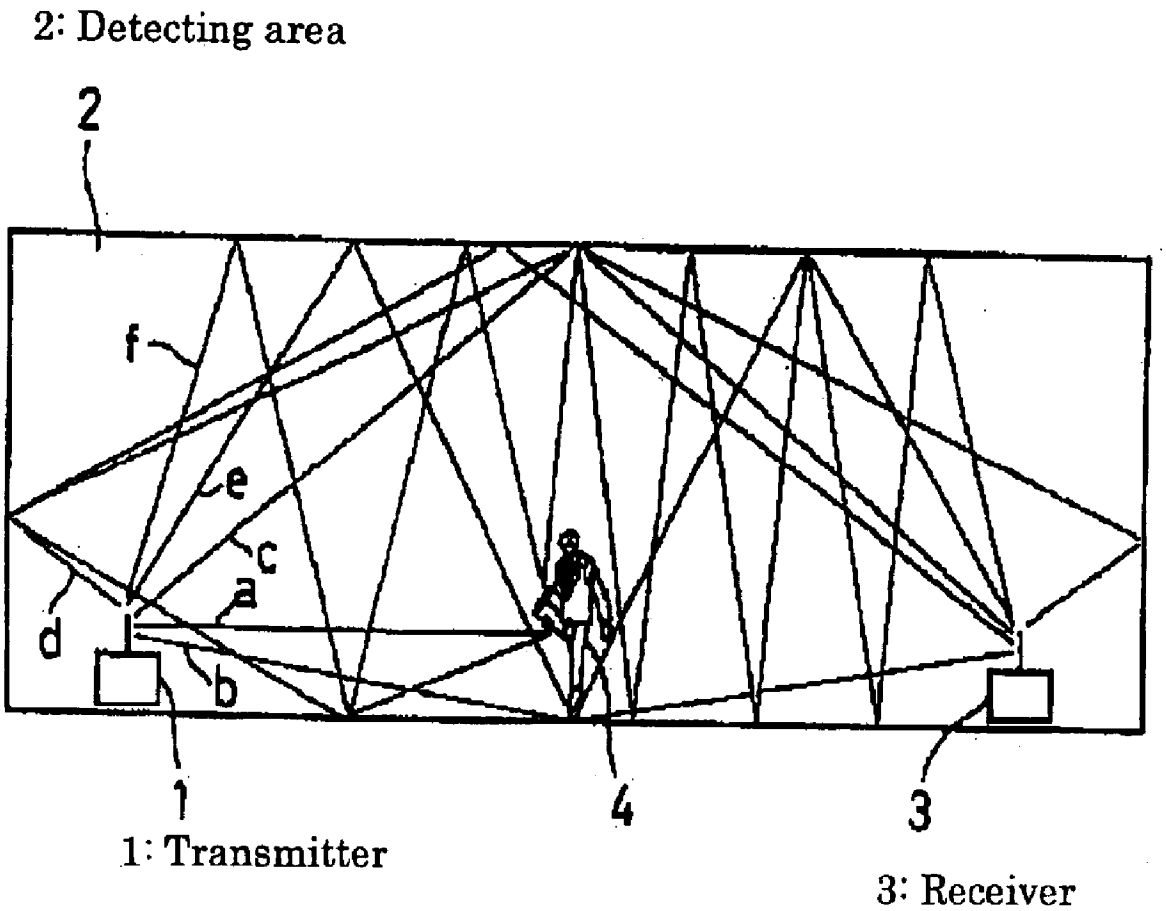
Figure 11 (PRIOR ART)
FIG. 11 is a diagram of the prior art technology.

In this case, the conventional technology experienced operational difficulties caused by the waves' output from sensors A and B interfering with each other. To address this, the present invention, as shown in FIG. 9, shifts the timing by using delay circuit 901 to eliminate any possible interference effects. In order to use the impulses, the timing delay can be very minimal, on the order of several nanoseconds between the A wave and B wave. Because of this, the sensing of the A wave and B wave can be considered to be virtually simultaneous. Even if the movement of the object was very fast, it would still be on the order of several tens-of milliseconds, which means that from the perspective of the object, the output of the A wave and B wave can be considered to be virtually simultaneous.

The Distance Measurement Function Between Communication Nodes

The present invention, in addition to the proximity sensors being able to perform surveillance as described above using proximity sensing of the objects inside the container, they are also able to measure the distance between communication nodes using impulse waves. If a suspicious object, etc. penetrated the container and caused any change in the status, this distance measurement function is performed to detect the resultant changes in the node-to-node distance. Thus, the surveillance is carried out in two stages, the object sensing for the object(s) of surveillance and the distance measurements between nodes.

The distance measurements between nodes will now be described by returning to FIG. 2. In the present invention, the wireless communication nodes are switched and each becomes the base point for the distance measurement in order to begin the distance measurement function where the base wireless communication node measures the distance to the other wireless communication nodes. To wit, at the wireless communication node to become the base point, the switch 201 is connected to the B position, at the other (partner) communication node to which the measurement is being made, switch 201 is connected to position C. All of the other wireless communication node switches remain connected to A. The base wireless communication node from which the measurement is to be made sends a pseudo-random code array (PN code) for distance measurement via the B terminal of the switch which is input into impulse generator. The various pulses which make up the PN code input into the pulse generator are converted into impulses by the impulse generator. Thus, the impulse array prepared in this manner is radiated to the outside via PA203 and transmitting antenna 204.

The wireless communication node designated at the node to which the measurement is being made receives the impulse array through receiving antenna 205, amplifies it in LNA206, and demodulates it in impulse demodulator 207. With that demodulated output, the PN code regenerator 208 regenerates the PN code, whereupon the data demodulator 209 output is input into switch 201 via terminal B, and impulse generator 202 converts it into an impulse, which is further amplified in PA203 before being transmitted from transmission antenna 204. In this manner, the partner wireless communication node responds to the base wireless communication node, and that signal is received through receiving antenna 205 of the base wireless communication node. At the base wireless communication node, the signal received by receiving antenna 205 is amplified at LNA206, demodulated at impulse demodulator 207, and the PN code is regenerated at the PN code regenerator 208. The interrelationship correlator 215 determines the interrelationship between the regenerated PN code and the array 214 used for measurement (PN code). When a maximum correlation value is determined, the amount of delay is determined over a time axis, and based upon that amount of delay, a determination is made of the distance between the base wireless communication node and the partner wireless communication node.

This distance computation 216, is based upon the time (delay time) back and forth between the base wireless communication node and its partner wireless communication node to which the distance is to be measured, and then after subtracting the required signal processing time, one half of the resulting time is used to compute the distance.

In cases in which it is impossible to implement the distance measurement by one or more of the wireless communication nodes with another when their turn comes up to make the measurement, the distance data between those nodes is set to −1. If the distance measurement is possible, that distance is set as the distance data between the base node and the other node. The distance between the base and the other wireless communication nodes is measured as each of the wireless communication nodes are switched to become the base node,. FIG. 10 shows the resulting distances between the communication nodes expressed as a network graph matrix. To wit, the network structure information is based upon the distances between the nodes. Since this network structure information is generated through the random positioning of the communication nodes inside of the container subject to surveillance, the security of the container may be confirmed by recording this network information at time of shipment, for example, at a surveillance center. After the shipment of said container, comparisons are made over specific time intervals between the original and current network structure information. Any difference detected between the two is indicative of the penetration by a suspicious object during the transport, and the container, upon arrival at its destination port can then be subjected to special handling, such as close inspection, to assure the safety of the container.

Effects of the Invention

As described above, the present invention employs microimpulse waves in the proximity sensors of each of the communication nodes to enable the detection of the distance to the objects lying inside of the container, the strength of the of the reflections, and the velocity at which they may be moving. Through the appropriate comparison of these detection results with the data produced at the time of the container's shipment, it is possible to detect whether or not any abnormal occurrences have taken place inside the container.

In addition, if the microimpulse waves are output in a specific direction, for example, in several layers that are parallel to the container walls, it is further possible to determine the direction of penetration of any suspicious article that cuts across the plane of the microimpulse waves.

Further, the distance measuring function between each of the communication nodes allows the distances between the nodes to be obtained, and that distance between the communication nodes, when obtained as network structure information, can be used for comparison with the original network structure information as a means to unfailingly detect any abnormalities occurring within the container.

What is claimed is:

1. A proximity sensor provided in each wireless communication node which is installed inside of an object of surveillance for surveying the inside status of said object of surveillance, comprising:

an output means to output microimpulse waves from the wireless communication node toward the three dimensional directions inside of said object of surveillance;

a receiving means to receive the reflected waves of said output microimpulse waves which are reflected on the articles loaded inside of said object of surveillance; and a detecting means to detect a characteristic data in said received reflected waves received by said receiving means for surveying the inside status of said object of surveillance, wherein said detecting means shares said characteristic data with other proximity sensors provided in said object of surveillance for obtaining a network structure information of said object.

2. A proximity sensor according to claim 1, wherein said characteristic data is defined by either a distance between said proximity sensor and said articles which cause said reflection, a reflection strength of said received reflected wave, or a moving speed of said articles.

3. A proximity sensor according to claim 1, wherein said received reflected waves are a plurality of reflected waves including a first reflected wave from said article.

4. A proximity sensor according to claim 1, wherein said characteristic data is detected by the modulated waveform which is obtained by modulating said received reflected waves with the locally oscillated waves.

5. A proximity sensor provided in each wireless communication node which is installed inside of the object of surveillance, said proximity sensor detecting a direction of unauthorized penetration in which an unauthorized article penetrates a wall of said object of surveillance, comprising:

an output means to output two layered microimpulse waves from the wireless communication node towards the two dimensional directions parallel to the wall of said object of surveillance;

a receiving means to receive two reflected waves of said two layered microimpulse waves which are reflected on said unauthorized article penetrating said wall of said object of surveillance; and a detecting means to detect a characteristic data in said two received reflected waves of said two layered microimpulse waves for detecting said direction of unauthorized penetration, wherein said detecting means shares said characteristic data with other proximity sensors provided in said object of surveillance for obtaining a network structure information of said object.

6. A proximity sensor according to claim 5, wherein said characteristic data is detected by the receiving time lag between said two received reflected waves of said two layered microimpulse waves.

7. A proximity sensor according to claim 5, wherein said output means outputs a plurality of layered microimpulse waves from the wireless communication node, each layered microimpulse wave being output through each slot provided in said wireless communication node, and said receiving means receives a plurality of reflected waves of said plurality of layered microimpulse waves.

8. A status surveillance system to monitor the status of an object of surveillance using microimpulse waves, comprising:

a first detecting means to detect a plurality of mutual distances between a plurality of communication nodes by outputting microimpulse waves toward the three dimensional directions inside of said object of surveillance, and obtain a network structure information of said object by said plurality of detected mutual distances; and a second detection means to detect a characteristic data in a plurality of reflected waves which are reflected on the articles loaded inside of said object of surveillance;

wherein said status surveillance system monitors said status of said object of surveillance by said network structure information and said characteristic data.

9. A status surveillance system according to claim 8;

wherein said network structure information is obtained by said plurality of detected mutual distances which are detected by the responding time lags of the responding microimpulse waves which are responses from other communication nodes, and said characteristic data is obtained by either a distance between said plurality of communication nodes and said articles which cause said reflection, a reflection strength of said received reflected wave, or a moving speed of said article.

10. A status surveillance system, according to claim 8, wherein said system records an initial data which is obtained from an initial characteristic data and network structure information obtained by said reflected waves in an initial environment, and compares said initial data with said characteristic data and said network structure information in a surveillance period, for monitoring said status of said object of surveillance.

11. A status surveillance system, according to claim 8, wherein said object of surveillance is a freight container that is transported by aircraft or ship.

12. A status surveying method to survey the inside status of an object of surveillance, comprising the steps of:

outputting microimpulse waves from a wireless communication node towards the three dimensional directions inside of said object of surveillance;

receiving the reflected waves of said output microimpulse waves which are reflected on the articles loaded inside of said object of surveillance;

detecting a characteristic data in said received reflected waves received by said receiving means for surveying the inside status of said object of surveillance; and sharing said characteristic data with other proximity sensors provided in said object of surveillance for obtaining a network structure information of said object.

13. A status surveying method to survey the inside status of an object of surveillance, comprising the steps of:

detecting a plurality of mutual distances between a plurality of communication nodes by outputting microimpulse waves towards the three dimensional directions inside of said object of surveillance, and obtain a network structure information of said object by said plurality of detected mutual distances;

detecting a characteristic data in a plurality of reflected waves which are reflected on the articles loaded inside of said object of surveillance; and monitoring said status of said object of surveillance by said network structure information and said characteristic data.

* * * * *